United States Patent [19]

Glade

[11] 4,282,667

[45] Aug. 11, 1981

[54] ADVERTISING POSTER DISPLAY FRAME

[76] Inventor: Gaston M. Glade, 4 Bis, rue Jean-Jaures, 77410 Claye Souilly, France

[21] Appl. No.: 88,001

[22] Filed: Oct. 25, 1979

[51] Int. Cl.[3] ..... G09F 3/18

[52] U.S. Cl. ..... 40/16; 40/152; 40/611

[58] Field of Search ..... 40/152, 155, 10, 16 R, 40/17, 611

[56] References Cited

U.S. PATENT DOCUMENTS

| | | | |
|---|---|---|---|
| 2,633,653 | 4/1953 | Angus et al. | 40/155 X |
| 2,777,232 | 1/1957 | Kulicke et al. | 40/155 |
| 3,425,147 | 2/1969 | Marx | 40/155 |
| 3,665,628 | 5/1972 | Dammond | 40/155 |
| 4,183,160 | 1/1980 | Brodersen | 40/152 |

*Primary Examiner*—Gene Mancene
*Assistant Examiner*—Wenceslao J. Contreras
*Attorney, Agent, or Firm*—Cesari and McKenna

[57] ABSTRACT

This display unit is formed from a support plate and a framing border fitting by their periphery into outer U section mouldings completing the frame, said mouldings being provided with an inner longitudinal ridge capable of maintaining, between the plate and the border, a certain spacing for insertion of the document to be presented.

7 Claims, 6 Drawing Figures

VI
VI
III
III
1
2
3
5
6
9
18
19
20
21

1
2
3
6
7
8
9
10
13
14
15
16
17
20

2
14
15
17
19

1
4
21

8
9
10
11
12

ADVERTISING POSTER DISPLAY FRAME

The present invention relates to a display unit for documents, more particularly for advertising posters, but which may also be used for non-advertising purposes, for example for presenting photos, engravings, lithographs, etc . . . , or even as a support for writing, for example a slate, or else a mirror.

Different forms of display units are known for advertising posters. These units prove however to be inconvenient in use. Furthermore, they are generally fairly complicated and so expensive.

The present invention has then as its principal aim to remedy these disadvantages and, for this, it provides a display unit for documents which is essentially characterized in that it is formed of a support plate and a framing border fitting peripherally into U section outer mouldings completing the frame, said mouldings being provided with an inner longitudinal ridge capable of maintaining, between the plate and the border, a certain space for insertion of the document to be presented.

Thus, the interlocking of the support plate and the border is effected solely by the outer mouldings. The display unit of the invention is then very practical in use since all that is required, to change documents, is to simply withdraw one of the mouldings, the old document then being taken out or the new one introduced without any difficulty, owing to the space provided for this purpose between the plate and the border.

It will be evident moreover that such a display unit can be made entirely from a plastic material, so inexpensively.

Preferably, the plate and the border are provided with peripheral ribs cooperating with corresponding grooves formed inside the mouldings, so as to provide fixing by clipping.

With this arrangement, the mouldings can only be withdrawn by exerting thereon a considerable pull, preferably by means of a tool, which ensures a certain inviolability of the display unit.

Moreover, each moulding is in addition provided with at least one inner transverse ridge cooperating with a corresponding slot in the support plate, for providing accurate positioning of said moulding during assembly of the display unit.

Preferably also, the corners of the framing border are indented so as to facilitate the insertion of the document between said border and the support plate.

In a particular embodiment of the invention, the display unit comprises further a folder inside which the document to be presented is inserted and which is formed from two flaps hinged to each other along a common edge, the upper flap of this folder being formed from a relatively rigid transparent plastic material, whereas the lower flap, made from any material, is connected to the upper flap by means of an adhesive strip, with a rod placed therebetween to form an articulation.

Of course, such a folder is really only useful when the document to be presented does not possess by itself sufficient rigidity, or when this document must be exposed to the elements.

One embodiment of the invention is described below by way of example, with reference to the accompanying drawings in which.

Figures 1, 2:
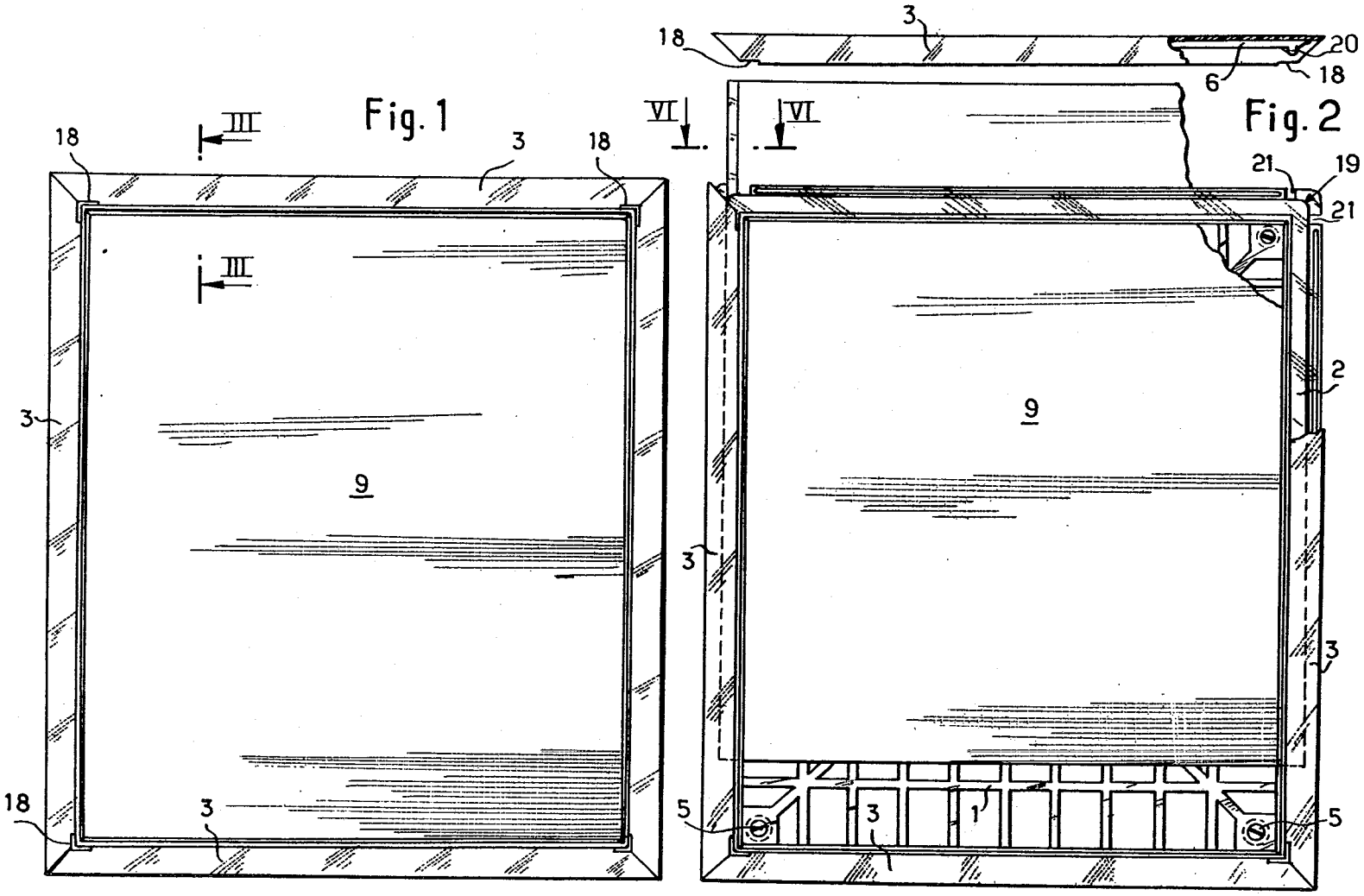
FIG. 1 is a top view of a document display unit according to the present invention.
FIG. 2 is a top view of the same display unit, but shown partially disassembled.

Referring first of all to FIGS. 1 and 2, it can be seen that the document display unit of the invention is formed essentially from a rectangular shaped support plate 1 and a correspondingly shaped framing border 2, fitting by their periphery into four U section outer mouldings 3, completing the frame. All these parts are advantageously made from moulded plastic material, therefore simply and inexpensively.

Figure 5:
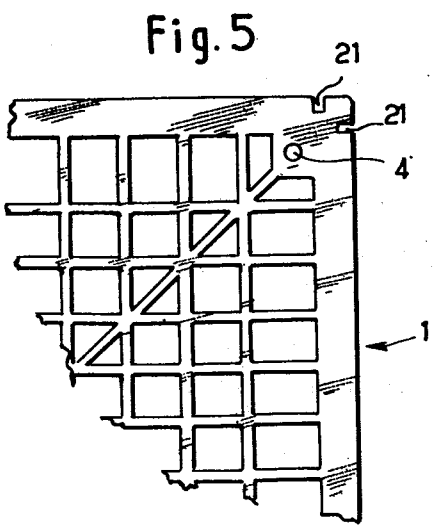
FIG. 5 is a partial top view of the support plate.

The support plate 1, which can be best seen in FIG. 5, has here an openwork form, for questions of cost and lightness, but of course it could also be solid. This plate comprises furthermore, in the four corners, bores 4 for fixing it to any rigid support, for example a wall, by means of screws such as 5.

Figure 4:
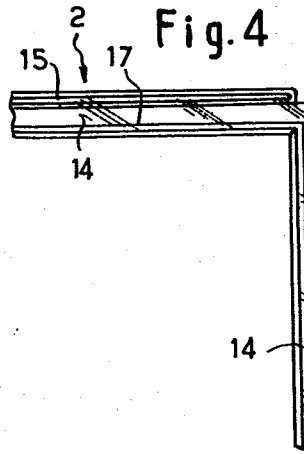
FIG. 4 is a partial top view of the framing border of this display unit.

As for border 2, which can be best seen in FIG. 4, it will be described in more detail further on. It will simply be noted here that its outer dimensions correspond exactly to those of plate 1.

Figure 3:
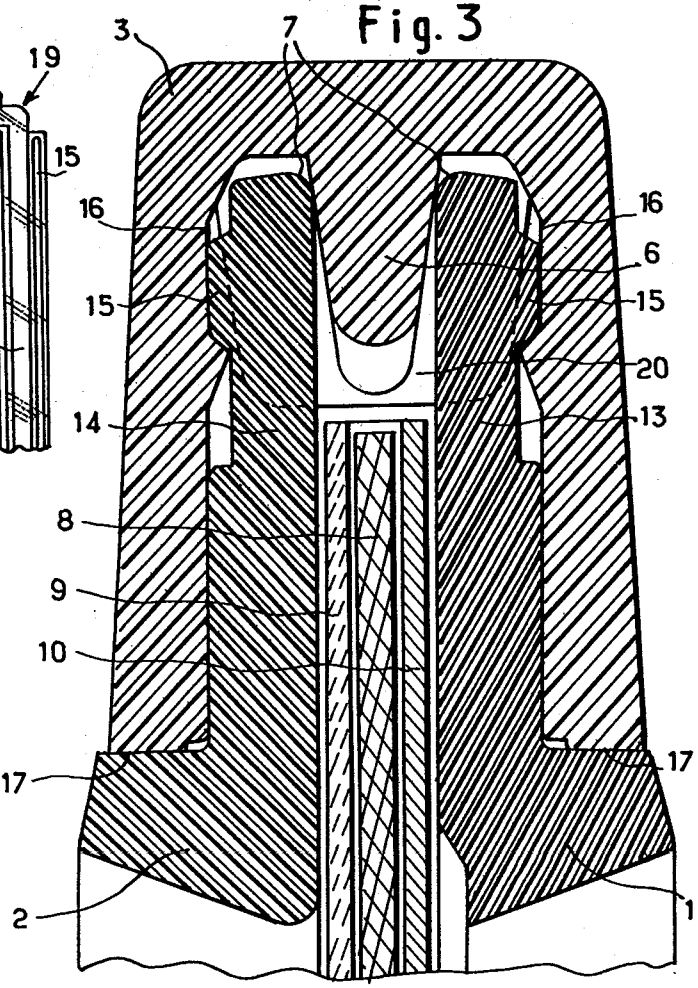
FIG. 3 is an enlarged sectional view along line III—III of FIG. 1.

Referring now to FIG. 3, it can be seen that each of the U section mouldings 3 comprises an inner longitudinal ridge 6 capable of maintaining a certain spacing between plate 1 and border 2. So as to facilitate assembly of the moulding, this ridge is given a sloping form with one end rounded. Similarly, the corresponding edges of the plate and of the border are provided rounded, as illustrated at 7.

The space thus provided between support plate 1 and border 2 by ridge 6 forms a housing for the document to be presented 8 which may then be inserted into the display unit or withdrawn therefrom without any difficulty. In the present case, it is a question of a relatively thin document, for example an advertising poster, which must then be supported so as to give it a certain steadiness. For this, the document 8 is inserted into a special folder comprising an upper flap 9 and a lower flap 10 hinged to one another along a common edge. In accordance with the invention, the upper flap is made from a relatively rigid transparent plastic material, whereas the lower flap is made from any inexpensive material. So as to further reduce the price of the folder, the lower flap may moreover, if necessary, be reduced to a simple strip small in width.

Figure 6:
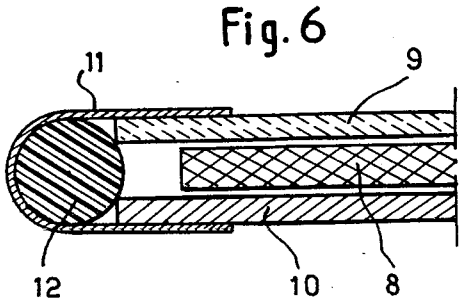
FIG. 6 is an enlarged sectional view along line VI—VI of FIG. 2.

As can be seen more clearly in FIG. 6, the connection between the two flaps is provided by means of an adhesive strip 11, with a plastic material rod 12 being inserted therebetween. This rod facilitates the hinging of the two flaps and allows moreover a space to be provided therebetween for housing document 8, so that the folder thus remains perfectly flat. It is evident however that such a folder is only really necessary when the document to be presented does not have itself sufficient rigidity. This folder could however also be useful when the document, although having sufficient rigidity, must be exposed to the outside, so as to protect it against the elements.

According to another characteristic of the present invention, the outer mouldings 3 are fixed by clipping them onto the periphery of the frame formed by plate 1 and border 2. To this end, the edges of the plate and the border are made thinner, as illustrated at 13 and 14, and comprise peripheral ribs 15 cooperating with corresponding grooves 16 provided on the inside of the mouldings. It will be noted further that these thinned parts 13 and 14 form stops 17 against which abut the edges of the moulding when this latter is in position.

With all these arrangements, the mouldings can only be withdrawn with great difficulty. Which ensures the virtual inviolability of the display unit of the invention. No reliable hold is in fact available and if the two flanges of the moulding are pressed together, the fixing due to the clipping is on the contrary reinforced. The display unit of the invention lends itself then particularly well to use in public places.

In fact, the mouldings can only be withdrawn easily by means of a tool, in this case a screwdriver or similar. To this end, each of the mouldings 3 is slightly hollowed out in the vicinity of its ends, as shown at 18, so as to thus define with the bearing face 17 of border 2, a slit for introducing the tip of the screwdriver.

Of course, the display unit of the invention may be used equally in both directions. In addition, all that is required to change documents is to withdraw one of the mouldings. The document may in fact be withdrawn from the display unit, not only through the large side but also through the small side, and this without any difficulty, owing to the space provided between plate 1 and border 2.

The introduction into the display unit of a new document, or of the folder containing said document if such be the case, is also effected without any difficulty. This introduction is moreover facilitated by the fact that the corners of border 2 are provided indented, as illustrated at 19, so as to provide a bearing zone at one of the corners of the document or of the folder.

The moulding previously withdrawn can be replaced without any difficulty. Each moulding comprises in fact, in the vicinity of its ends, an inner transverse ridge 20 cooperating with a corresponding slit 21 provided in support plate 1, which ensures the accurate positioning thereof in relation to said plate in the longitudinal direction. All that is required is to press the moulding until ribs 15 fit into grooves 16, thus providing efficient fixing of said moulding by clipping.

The display unit of the invention proves then in short to be extremely practical in use, particularly in the case of advertising posters where it is often necessary to change documents.

I claim:

1. A document display unit, characterized in that it comprises a support plate, a framing border dimensioned so that its outer edge registers with said plate and its inner edge overlies said plate a selected distance from the plate edge, and mouldings having a resilient, generally U-shaped cross-section whose legs are shorter than the width of the border for engaging over the peripheral edge margins of said registering plate and border, said mouldings having inwardly projecting longitudinal ridges so that when the mouldings are engaged over the edge margins of the registering plate and border, they clamp the plate and border together on opposite sides of said ridge, thereby providing a selected spacing between the plate and border for the document to be displayed while exposing an edge margin of said border inboard of the mouldings all around the document.

2. A document display unit according to claim 1, characterized in that the remote surfaces of the plate and border on the one hand and the inner surfaces of the moulding legs on the other hand are formed so as to interfit with one another, the mouldings thereby functioning as clips.

3. A document display unit according to claim 1 or 2, characterized in that it further includes interfitting means on said plate and each of said mouldings for fixing the longitudinal position of each said mouldings relative to the plate edge margin on which it is engaged.

4. A document display unit according to claim 1 or 2, characterized in that at least one outside corner of the framing border is indented so as to provide a bearing zone at a corner of the document to facilitate removing it from the display unit.

5. A document display unit according to claim 1 or 2, characterized in that it comprises furthermore a folder inside which the document to be presented is inserted and which is formed from two flaps hinged together along a common edge, the upper flap of this folder being made from a relatively rigid transparent plastic material, whereas the lower flap, made from any material, is connected to the upper flap by means of an adhesive strip, with a rod placed therebetween to form a hinge said folder being dimensioned to fit between the plate and border inboard of said moulding ridges.

6. A document display unit according to claim 3 wherein the interfitting means comprises a transverse inner ridge formed on each moulding and a cooperating recess formed in the plate edge margin underlying that moulding.

7. A document display unit according to claim 1 wherein the exposed inner edge margin of said border is thicker than the remainder of said border so that its exposed surface is more or less coplanar with the corresponding front surface of the mouldings.

* * * * *